US006125967A

United States Patent [19]

Takahashi

[11] Patent Number: 6,125,967

[45] Date of Patent: Oct. 3, 2000

[54] FOOTHOLD

[75] Inventor: Eizo Takahashi, Soka, Japan

[73] Assignee: Miyama Kogyo Kabushiki Kaisha, Saitama-ken, Japan

[21] Appl. No.: 09/304,165

[22] Filed: Apr. 30, 1999

[51] Int. Cl.[7] ..... E06C 9/04

[52] U.S. Cl. ..... 182/92; 182/129; 182/18

[58] Field of Search ..... 182/90, 92, 129, 182/18

[56] References Cited

U.S. PATENT DOCUMENTS

| | | | |
|---|---|---|---|
| 165,403 | 7/1875 | Blatt . | |
| 601,849 | 4/1898 | Aiken . | |
| 1,729,963 | 10/1929 | Pease . | |
| 2,064,803 | 12/1936 | Grove | 182/90 |
| 2,511,077 | 6/1950 | Race, Jr. . | |
| 3,099,333 | 7/1963 | Hollaender | 182/90 |
| 3,125,177 | 3/1964 | Paller | 248/503 |
| 4,100,997 | 7/1978 | Peacock . | |
| 4,241,543 | 12/1980 | Foscarini et al. . | |
| 4,610,330 | 9/1986 | Borst | 182/90 |
| 4,655,318 | 4/1987 | Bowen . | |
| 4,660,681 | 4/1987 | Zenhausern . | |
| 4,702,349 | 10/1987 | Zenhausern . | |
| 4,771,861 | 9/1988 | Zenhausern et al. . | |
| 4,778,032 | 10/1988 | Takahashi | 182/90 |
| 4,869,342 | 9/1989 | Borst . | |
| 5,427,198 | 6/1995 | Walsh . | |
| 5,752,579 | 5/1998 | Takahashi . | |
| 5,772,358 | 6/1998 | Takahashi . | |
| 5,944,140 | 8/1999 | Takahashi | 182/92 |

FOREIGN PATENT DOCUMENTS

| | | |
|---|---|---|
| 173 227 | 3/1986 | European Pat. Off. . |
| 56-30258 | of 1981 | Japan . |
| 4-4040 | 6/1992 | Japan . |
| 6-71899 | 7/1994 | Japan . |
| 2700618 | 3/1997 | Japan . |
| 28 19106 | 7/1997 | Japan . |
| 10-292412 | 11/1998 | Japan . |

*Primary Examiner*—Alvin Chin-Shue

*Attorney, Agent, or Firm*—Flynn, Theil, Boutell & Tanis, P.C.

[57] ABSTRACT

There is provided a foothold comprising a tread, side portions positioned at both ends of the tread, legs to be inserted into a concrete wall, the side portions and the legs extended from the side portions being separated from the tread, rise portions provided at both ends of the tread having horizontal long holes at the upper parts thereof through which one end of each side portion penetrates so as to be fixed, and a plurality of fins provided on the outer peripheries of the legs toward the side portions. The interval between both side portions can be adjusted by fixing side portions in a state where one end of each side portion penetrates each long hole, thereby boring holes for embedding therein in the concrete wall without requiring accuracy, resulting in that the foothold can be easily fixed to the concrete wall, and simplified in construction, so that a safe foothold having the tread from which both feet or foot of a person is not liable to slip can be provided.

10 Claims, 2 Drawing Sheets

FOOTHOLD

BACKGROUND OF THE INVENTION

1. Field of the Invention:

The present invention relates to a foothold comprising a tread, side portions continued and positioned at both sides of the tread and legs to be inserted into a concrete.

2. Description of the Related Art:

There is a conventional foothold having a tread, side portions continued and positioned at both sides of the tread and legs to be inserted into a concrete wall, for example, as disclosed in Japanese Utility Model Laid-Open Publication No. 56-30258, wherein the side portions and legs continued from the side portions are separated from the tread and the tread has rising portions provided at both ends thereof and projections provided adjacent to the rising portions and extending downward and having circular holes through which one end of each side portion penetrates to fix the foothold.

However, in the conventional foothold set forth above, since the side portions are fixed to the circular holes in a state where one end of side portions penetrate circular holes, the interval between both side portions is restricted, the interval between both holes bored in the concrete wall to be embedded therein is also restricted, and hence both holes need high accuracy, causing a problem that the boring of the concrete wall is troublesome, and the construction of the foothold having the rising portions and projections become complex.

SUMMARY OF THE INVENTION

The invention has been made in view of the conventional foothold having the problems set forth above. It is an object of the invention to provide a foothold capable of adjusting the interval between both side portions by fixing side portions in a state where one end of each side portion penetrates each long hole, thereby boring holes for embedding side portions therein in the concrete wall without requiring accuracy, resulting in that the foothold can be easily fixed to the concrete wall, and simplified in construction.

To achieve the above objects, a foothold according to the first aspect of the invention comprises a tread, side portions positioned at both ends of the tread, legs to be inserted into a concrete wall, the side portions and the legs extended from the side portions being separated from the tread, rise portions provided at both ends of the tread having horizontal long holes at the upper parts thereof through which one end of each side portion penetrates so as to be fixed, and a plurality of fins provided on the outer peripheries of the legs toward the side portions.

Further, according to the second aspect of the invention, an upper surface of the tread is inclined upward from the central portion toward both ends in the range of 1 to 5 degrees.

Still further, the foothold according to the third aspect of the invention comprises reflectors provided at both ends of the tread, said reflectors being red at right side and green at left side.

Still further, the foothold according to the fourth aspect of the invention comprises a wave-like grip portion formed at an inner side surface of the tread in the axial direction thereof, and another wave-like grip portion having irregularities on a surface thereof at the lower surface of the tread in the axial direction.

Still further, the foothold according to the fifth aspect of the invention comprises a tread, side portions positioned at both ends of the tread, legs to be inserted into a concrete wall, the side portions and the legs extended from the side portions being separated from the tread, rise portions provided at both ends of the tread having horizontal long holes at the upper parts thereof through which one end of each side portion penetrates so as to be fixed, and a plurality of fins provided on the outer peripheries of the legs toward the side portions, wherein an upper surface of said tread is inclined upward from the central portion toward both ends in the range of 1 to 5 degrees, said foothold further comprising reflectors provided at both ends of the tread, said reflectors being red at right side and green at left side, and a wave-like grip portion formed at an inner side surface of the tread in the axial direction thereof, and another wave-like grip portion having irregularities on a surface thereof at the lower surface of the tread in the axial direction.

DESCRIPTION OF THE PREFERRED EMBODIMENTS

Figure 1:
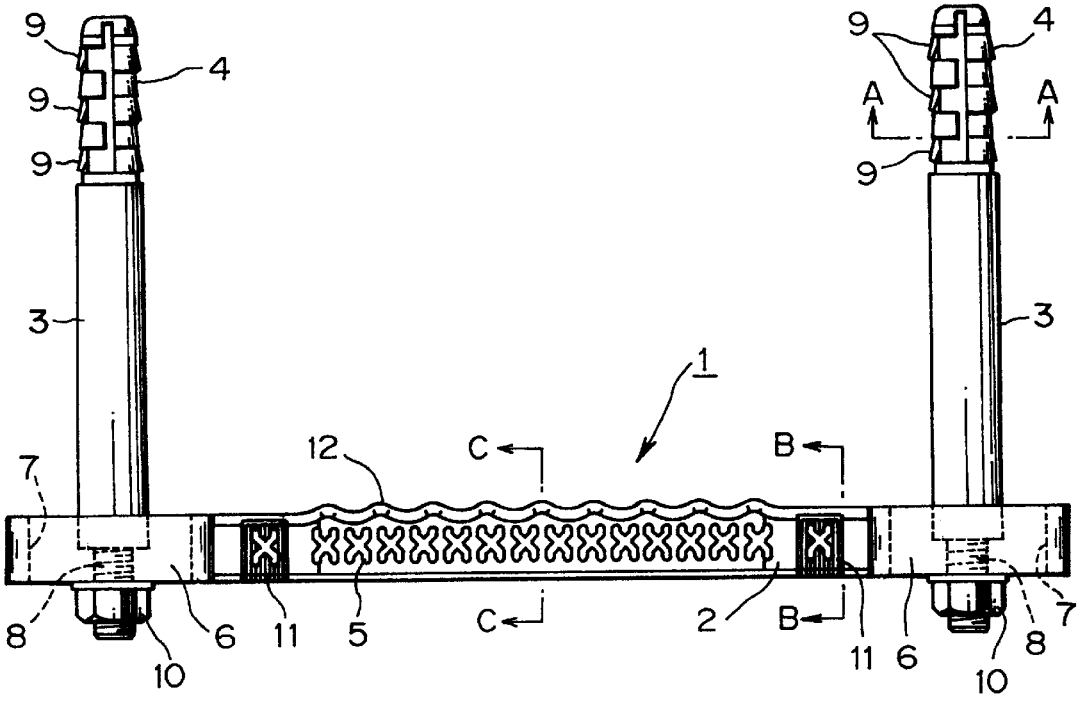
FIG. 1 is a plan view showing a foothold according to a preferred embodiment of the invention.
Figure 2:
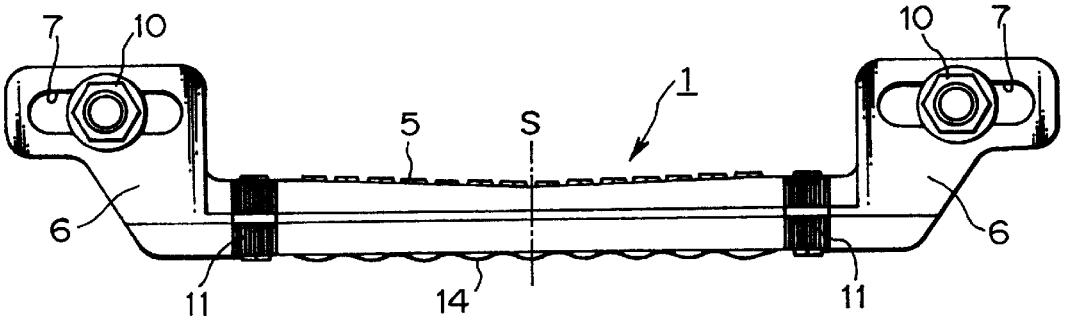
FIG. 2 is a front view in FIG. 1.
Figure 3:
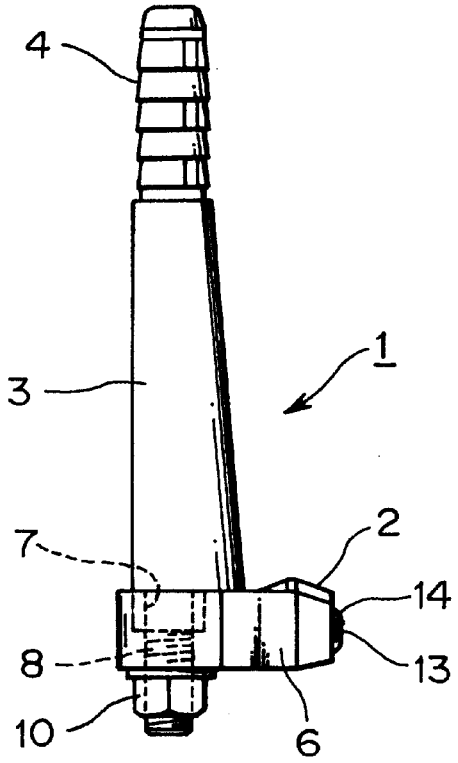
FIG. 3 is a side view in FIG. 1.
Figure 4:
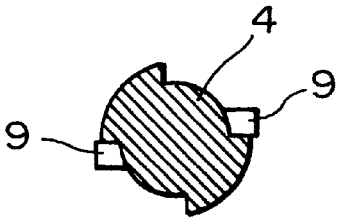
FIG. 4 is an enlarged sectional view taken along the line A—A in FIG. 1.

A foothold according to a preferred embodiment is now described with reference to FIGS. 1 to FIG. 6.

In these figures, reference numeral 1 depicts an entire foothold and comprises a tread 2, side portions 3 positioned at both sides of the tread 2 and legs 4 to be inserted into a concrete wall, etc., wherein the side portions 3 and legs 4 are formed separately from the tread 2. Slip prevention patterns 5 are formed on the substantially entire surface of the tread 2. Rise portions 6 are formed at both ends of the tread 2, and long holes 7 are bored horizontally on the rise portions 6 at the upper portions thereof.

Further, the side portions 3 and the legs 4 are formed integrally, screws 8 are screwed on the side portions 3 at each one end thereof and positioned to penetrate the long holes 7 of the rise portions 6. A plurality of fins are provided in plural stages (e.g., three stages) on the outer peripheries of the legs 4, which are extended from the side portions 3 and embedded in the concrete wall (not shown), toward the side portions 3 in the axial direction (see FIGS. 1 and 4). Respective tip ends of the contact support members 9 are slightly curved to enlarge outward in diameter.

In the foothold having the construction set forth, the screws 8 of the side portions 3 are forced to penetrate the long holes 7 of the rise portions 6 formed in the tread 2 and they are temporarily fixed by nuts 10. Subsequently, epoxy resin and so forth is filled in the holes bored in the concrete wall and so force, then the legs 4 of the foothold 1 are inserted into the epoxy resin, i.e., the holes of the concrete wall in a state where the plurality of fins 9 are pressed against inner walls of the holes. At this time, if the portions of the legs 4 on the concrete wall are not aligned with the holes bored in the concrete wall, the nuts 10 are loosened to move the side portions 3 in the rage of the lengths of the long holes 7 so as to adjust the interval between the side portions 3 are conformed to the interval of holes bored in the concrete wall. Thereafter, the nuts 10 are fastened so that the foothold 1 is easily and accurately fixed to the concrete wall and so forth. Since the plurality of fins 9 are retained by the holes bored in the concrete wall after the fixation of the foothold 1, the foothold 1 does not come off from the concrete wall.

Further, since the rise portions 6 are provided on both ends of the tread 2, both feet or foot of a person is not liable to slip from the tread 2.

Further, if the upper surface of the tread 2 is varied to incline upward from the central portion S toward both ends in the range of 1 to 5 degrees (see FIG. 2), both feet or foot of a person can be placed stably on the upper surface of the tread 2 so that the person can go up and down the foothold.

Figure 5:
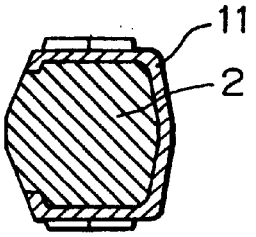
FIG. 5 is an enlarged sectional view taken along the line B—B in FIG. 1.
Figure 6:
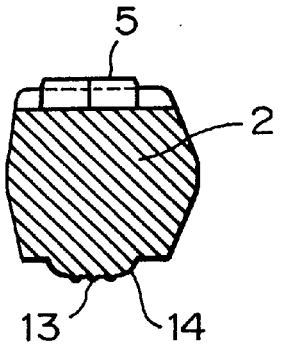
FIG. 6 is an enlarged sectional view taken along the line C—C in FIG. 1.

Still further, if reflectors 11 are provided on both end corners of the tread 2, if the right reflector 11 is red while the left reflector 11 is green, the right and left positions of the foothold 1 are made clear, thereby orienting the foothold in a specific direction (see FIGS. 1 and 5).

More still further, if the wave-like grip portion 12 is provided on the tread 2 at the inner side thereof in the axial direction thereof, and another wave-like grip portion 14 having irregularities 13 is formed on the tread 2 at the lower surface thereof (see FIGS. 2 and 6), it is normally conceived that the person goes up and down the foothold 1 while gripping the foothold 1 that is positioned several stages above the foothold 1 on which the person places his or her both legs, the tread 2 can be easily gripped by the person owing to the formation of the wave shape on the inner side of the tread 2 in the axial direction. Further, since the tread 2 has the wave-like grip portion 14 having the irregularities 13 on the lower surface of the tread 2 in the axial direction, both hands can be prevented from slipping so that the person can go up and down the foothold 1 with safety.

According to the foothold of the first aspect of the invention, since the foothold comprises a tread, side portions positioned at both ends of the tread, legs to be inserted into a concrete wall, the side portions and the legs extended from the side portions being separated from the tread, rise portions provided at both ends of the tread having horizontal long holes at the upper parts thereof through which one end of each side portion penetrates so as to be fixed, and a plurality of fins provided on the outer peripheries of the legs toward the side portions, the interval between both side portions can be adjusted by fixing side portions in a state where one end of each side portion penetrates each long hole, thereby boring holes for embedding therein in the concrete wall without requiring accuracy, resulting in that the foothold can be easily fixed to the concrete wall, and simplified in construction, so that a safe foothold having the tread from which both feet or foot of a person is not liable to slip can be provided.

According to the foothold of the second aspect of the invention, since an upper surface of said tread is inclined upward from the central portion toward both ends in the range of 1 to 5 degrees, both legs of a person who goes up and down the foothold can be stably placed on the upper surface of the tread, so that the person can safely go up and down.

According to the foothold of the third aspect of the invention, Since reflectors are provided on both end corners of the tread and the right reflector is red while the left reflector is green, the right and left positions of the foothold are made clear, thereby orienting the foothold in a specific direction.

According to the foothold of the fourth aspect of the invention, since another wave-like grip portion having irregularities on a surface thereof at the lower surface of the tread is formed in the axial direction, the person can more securely grip the tread, thereby providing more safe foothold.

According to the foothold of the fifth aspect of the invention, since the foothold has all the effects set forth above, thereby providing more excellent foothold.

What is claimed is:

1. A foothold comprising:

an elongate tread;

an upraised portion fixed to each end of said tread, said upraised portions extending upwardly from said tread and including a hole opening transversely through each said upraised portion, said holes being elongated in the elongate direction of said tread; and elongate side leg assemblies at one end adapted to be connected to a wall in a spaced apart manner, a second end of each said side leg assembly being received in a respective said hole of said upraised portion to connect said tread to said side leg assemblies thereby connect said tread to the wall, each said side leg assembly being adapted to be connected to the wall within a range of positions corresponding to the length of said holes so that said side leg assemblies need not be precisely spaced from each other to be received in respective said holes.

2. The foothold according to claim 1, wherein an upper surface of said tread is inclined upward from a central portion toward both ends in the range of 1 to 5 degrees.

3. The foothold according to claim 1, wherein said tread includes reflectors provided at both ends thereof, said reflectors being red at a right said end and green at a left said end.

4. The foothold according to claim 1, wherein said tread includes a wave-like grip portion formed at an inner side surface of the tread, and another wave-like grip portion having irregularities on a surface thereof at the lower surface of the tread.

5. The foothold according to claim 1, wherein said holes open through said upraised portions in a direction which is perpendicular to said tread.

6. The foothold according to claim 1, wherein said holes are disposed above an upper surface of said tread.

7. The foothold according to claim 6, wherein said upper surface of said tread defines a foot supporting area that is limited in the elongate direction by said upraised portion at each end of said tread which helps prevent a user's foot from slipping off the ends of said foot supporting area.

8. The foothold according to claim 1, wherein said side leg assemblies each include a leg having fins for fixing said leg in a wall and an elongate side portion connected at one end to said leg and at the other end to a said upraised portion.

9. The foothold according to claim 8, wherein each said side leg assembly includes a threaded part extending through a corresponding said hole and a fastener received on said threaded part on a side of said upraised portion remote from the wall to fix said upraised portion to the respective said side leg assembly.

10. A foothold comprising:

an elongate tread having an upper surface inclined upwardly from a central portion toward both ends in the range of 1 to 5 degrees and reflectors provided at both ends of the tread, said reflectors being one color at a right said end and another color at a left said end;

side portions positioned at both ends of the tread;

legs respectively connected to said side portions and adapted to be inserted into a concrete wall, each said leg including a plurality of fins provided on the outer periphery thereof;

upraised portions provided at both ends of the tread, each said upraised portion having a horizontally elongate hole at the upper part thereof through which one end of a said side portion penetrates so as to be fixed to said upraised portion; and a wave-like grip portion formed at an inner side surface of the tread, and another wave-like grip portion having irregularities on a surface thereof at the lower surface of the tread.

* * * * *